US007185684B2

(12) United States Patent
Nguyen

(10) Patent No.: US 7,185,684 B2
(45) Date of Patent: Mar. 6, 2007

(54) APPARATUS FOR DISPENSING PROPANE GAS

(76) Inventor: Van H. Nguyen, 17280 Newhope St., Suite 1, Fountain Valley, CA (US) 92708

( * ) Notice: Subject to any disclaimer, the term of this patent is extended or adjusted under 35 U.S.C. 154(b) by 792 days.

(21) Appl. No.: 10/224,824

(22) Filed: Aug. 21, 2002

(65) Prior Publication Data

US 2003/0051766 A1 Mar. 20, 2003

Related U.S. Application Data

(60) Provisional application No. 60/317,066, filed on Sep. 2, 2001, provisional application No. 60/317,360, filed on Sep. 4, 2001.

(51) Int. Cl.
*B65B 1/04* (2006.01)

(52) U.S. Cl. ..... 141/231; 141/83; 141/18

(58) Field of Classification Search ..... 141/2, 141/18, 94, 95, 198, 192, 231, 83; 222/608
See application file for complete search history.

(56) References Cited

U.S. PATENT DOCUMENTS

| | | | | |
|---|---|---|---|---|
| 5,238,030 | A * | 8/1993 | Miller et al. | 141/4 |
| 5,913,344 | A * | 6/1999 | Wronski et al. | 141/83 |
| 5,954,099 | A * | 9/1999 | Princiotta et al. | 141/18 |
| 6,089,420 | A * | 7/2000 | Rodriguez | 222/608 |
| 6,394,151 | B1 * | 5/2002 | Donaldson et al. | 141/99 |
| 6,609,381 | B1 * | 8/2003 | Morgan | 62/50.1 |

* cited by examiner

*Primary Examiner*—Steven O. Douglas
(74) *Attorney, Agent, or Firm*—Christie, Parker & Hale, LLP.

(57) ABSTRACT

A mobile fill station for filling propane cylinders by weight and volume. There can be up to three cabinets in the system wherein any one of the cabinets can have a beam scale with a hydraulic automatic stop device to stop filling automatically as the total weight of the cylinder reaches a pre-set scale limit. Any one of the cabinets can also include a flow meter to stop filling when an operator monitors an amount on the meter and manually stops propane flow. The cabinets could also include an electronic scale with a digital indicator where filling stops automatically as the total weight of the cylinder reaches a pre-set computer limit.

19 Claims, 6 Drawing Sheets

APPARATUS FOR DISPENSING PROPANE GAS

CROSS-REFERENCE TO RELATED APPLICATION(S)

This application claims priority from U.S. Provisional Application No. 60/317,066 filed Sep. 2, 2001, and Ser. No. 60/317,360 filed Sep. 4, 2001.

FIELD OF THE INVENTION

This invention relates to propane dispensing systems and more particularly to a mobile fill station designed for propane cylinders and LP gas cylinders.

BACKGROUND OF THE INVENTION

Propane is a liquified petroleum gas and aromatic hydrocarbon that may be utilized as a gaseous fuel. Unlike methane vapor that is lighter than air, propane vapor is heavier than air. Liquid propane will vaporize at any temperature above −44° F. Propane, and all other hydrocarbon-based fuels, must be kept away from open flames and ignition sources. Propane must be handled with care and safety, particularly when filling propane tanks. Propane is sold as a liquid by the pound or as a vapor by the cubic foot. As ambient temperature rises, propane vapor pressure rises. When ambient temperature drops, propane vapor pressure drops.

Propane is typically sold and stored in portable containers for home use. When a container is filled to its proper liquid level, it will be approximately 80% full. The remaining 20% of the container's volume contains propane vapor. Propane vapor is typically consumed by household appliances. The vapor space in the container also provides room for the expansion of liquid propane. Liquid propane has a moderate coefficient of expansion and, accordingly, expands greatly when subjected to temperature increases. If a container is filled beyond its maximum permitted liquid filling density, a situation may develop in which there will not be enough space available to accommodate the liquid propane's expansion. When an overfilled container is exposed to any temperature increase, hazardous conditions may occur. Consequently, a need exists for a propane tank filling system which is able to fill a propane tank to its appropriate level economically and safely.

SUMMARY OF THE INVENTION

The present invention is directed to a mobile fill station designed to be an economical filling station for propane cylinders and LP gas cylinders. The present invention economically and safely fills propane and LP gas containers through weight by scales and by volume through flow meters. In one embodiment there can be up three cabinets in the system for filling the gas containers. One of the cabinets can include a beam scale with hydraulic automatic stop devices wherein the container filling stops automatically by the hydraulic device as the total weight of the cylinder reaches a pre-set scale limit. For a cabinet including a flow meter, the filling of the container is stopped when the operator sees the amount on the meter and manually stops the flow. A cabinet could also include an electronic scale with a digital indicator wherein the filling stops automatically as the total weight of the cylinder reaches a pre-set computer limit. The mobile filling station of the present invention is compatible with all propane/LPG storage facilities, gas stations, and dispensing/filling centers.

DETAILED DESCRIPTION OF THE INVENTION

Figure 1:
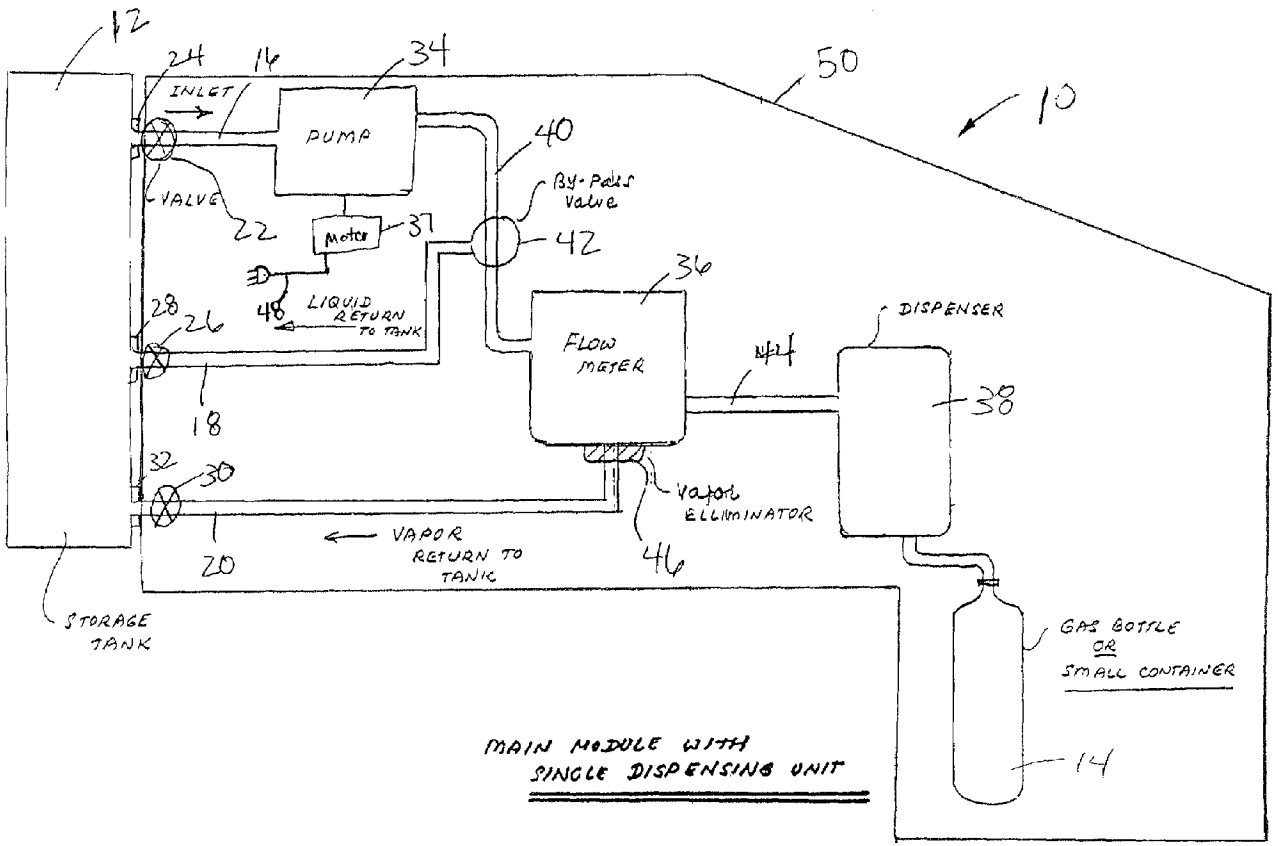
FIG. 1 is a schematic illustration of a first embodiment mobile filling station of the present invention.

A first embodiment mobile fill station 10 of the present invention is shown in FIG. 1. The mobile fill station 10 is connected to a propane storage tank 12 in order to fill a propane or LPG cylinder 14. The mobile fill station 10 is connected to the storage tank 12 by a liquid in line 16, a liquid out bypass return line 18 and a vapor out line 20. The liquid in line 16 can be a 1.5" diameter pipe connected to the storage tank with a 3" or 2" internal valve 22. The assembly for connecting the liquid in line to the storage tank also includes a pneumatic actuator, ball valve, flexible steel connector, Y-strainer flexible hose connector, and a reducing bushing for connecting the line by a forged steel coupling, all generally referred to as reference numeral 24. The liquid out bypass return line 18 is connected to the storage tank 12 by a 1" diameter pipe connection having a 2" internal valve 26 also having a connection assembly including a pneumatic actuator, ball valve, flexible steel connector and reducing bushing generally referred to as reference numeral 28. The vapor outline 20 is typically a 1" diameter pipe connected to the storage tank 12 with a 2" internal valve 30 and is attached to the storage tank 12 by a connection assembly 32 comprising a pneumatic actuator, ball valve, flexible steel coupling and reducing bushing.

Propane is drawn through the liquid in line by a pump 34 and into a flow meter 36 and ultimately into the propane cylinder 14 through dispenser 38. Pump 34 can be a Smith Pump having a maximum pumping capacity of 35 gallons per minute to 43 gallons per minute (132 liters per minute to 165 liters per minute) Pump 34 is driven by a motor 36 which can be a Baldor Explosion-Proof 3HP motor. The flow meter 36 can be a Liqua-Tech LPG Flow Meter having a maximum 18 gallon per minute flow rate (68 liters per minute). The pump 34 and the flow meter 36 are connected by pipe 40 which preferably is Bell Pipe Extra Heavy Schedule 80 Pipe (material A 150FS). Pipe fittings for the Bell Pipe are heavy forged steel, 2,000 lbs. and/or 3,000 lbs. of the same material. A bypass valve 42 is positioned in pipe 40 for the return of propane gas to the storage tank by liquid out bypass return line 18. The bypass valve can be a Fisher, Apollo, Rego or Smith valve of the ball, by-pass, back-check or hydro-relief variety. The propane gas flows through the flow meter to the dispenser through pipe 44 similar to pipe 40. Flow meter 36 also has a vapor eliminator 46 for the return of propane vapor to the storage tank via vapor out line 20.

The dispenser 38 can be a hydraulic automatic stop filling system or a quick acting adapter. The mobile fill station has an electrical connection 48 typically a Killark Explosive Proof Electrical Control Switch Box. The entire mobile fill station 10 is contained within a cabinet 50.

Figure 2A:
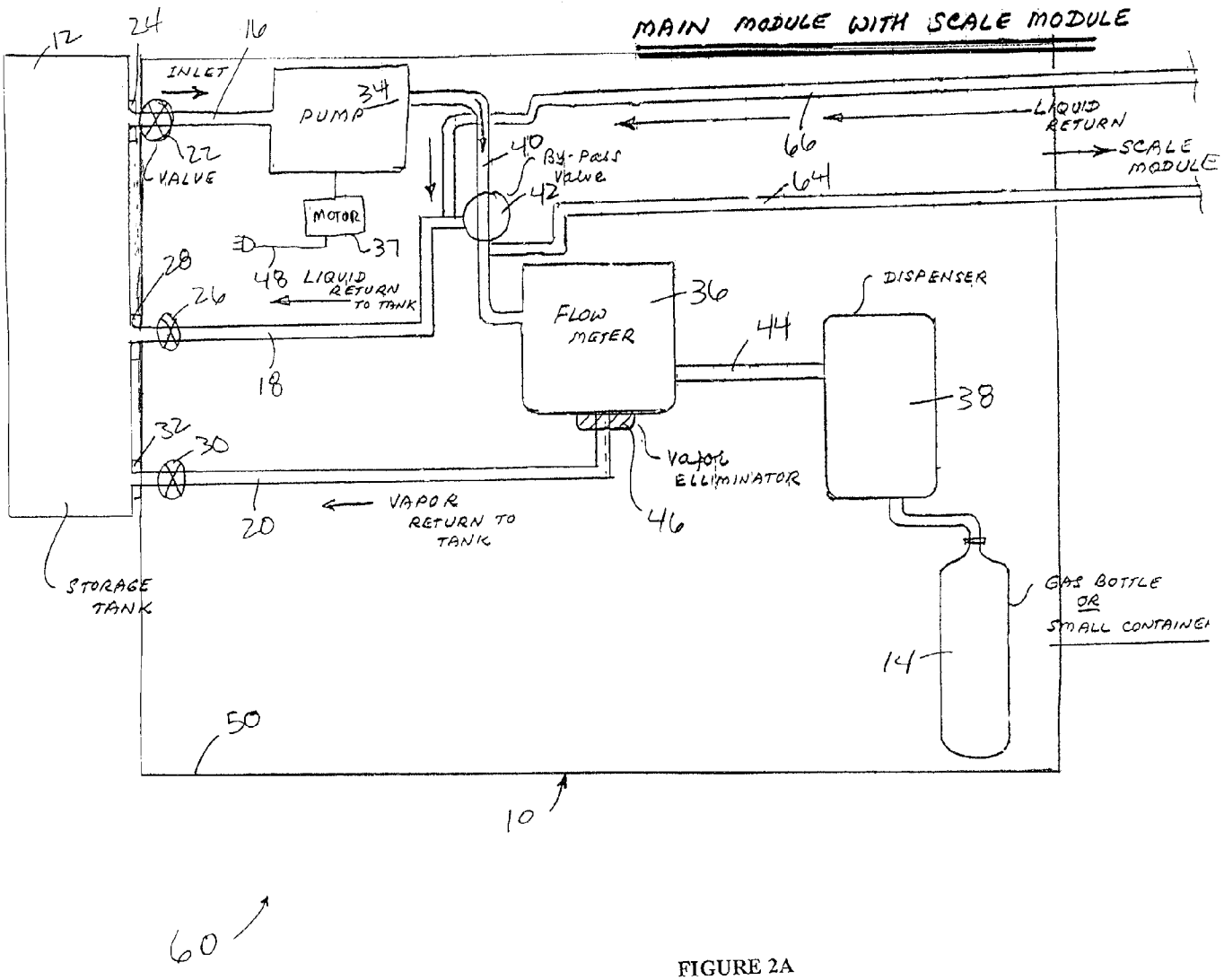
FIGS. 2A and 2B are a schematic illustration of a first alternative embodiment of the present invention.
Figure 2B:
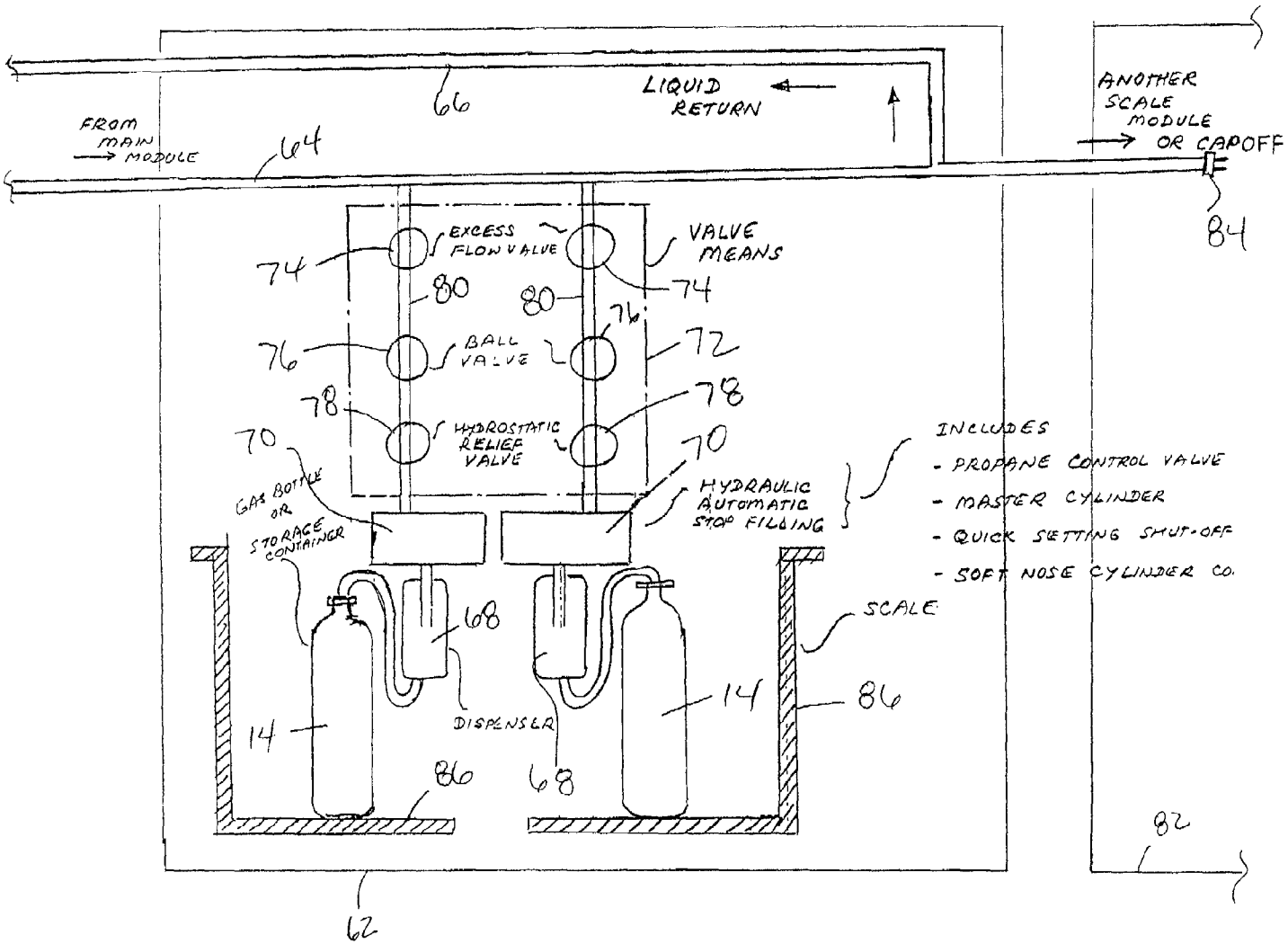

FIGS. 2A and 2B illustrate a first alternative embodiment mobile fill station 60 in accordance with the present invention. Mobile fill station 60 is a multiple cabinet station having a first cabinet including mobile fill station 10 of FIG. 1 as shown in FIG. 2A and a second cabinet 62 shown in FIG. 2B. Cabinets 50 and 62 are connected by liquid in line 64 and liquid return line 66. Liquid in line 64 is connected to line 40 below bypass valve 42. Liquid return line 66 connects to liquid out bypass return line 18 to return liquid to the storage tank 12. Liquid in and liquid return lines 64 and 66 are pipes similar to pipes 40 and 44 and are attached to pipes 44 and liquid return line 18 by conventional connections.

In cabinet 62 propane cylinders 14 are filled by dispensers 68. Dispensers 68 include hydraulic automatic stops 70 and also includes a propane control valve, master cylinder, quick setting shutoff and a soft nosed cylinder coupling. The propane enters the dispenser from liquid in line 64 through a set of valves 72 including an excess flow valve 74, a ball valve 76 and a hydrostatic relief valve 78. The valve means 72 are connected by pipes 80 extending between in line 64 and hydraulic automatic stop 70. Liquid in line 64 can extend out of cabinet 62 and into a third cabinet 82 if mobile fill station 60 requires a third cabinet or the line can be capped off 84. Propane cylinders 14 located in cabinet 62 are positioned on beam scales 86 which work in conjunction with the hydraulic automatic stop to automatically stop filling the cylinders as the total weight of the cylinder reaches a pre-set scale limit. The scale can be a Fairbanks scale with a 360 lb. maximum (163 kg).

Figure 3:
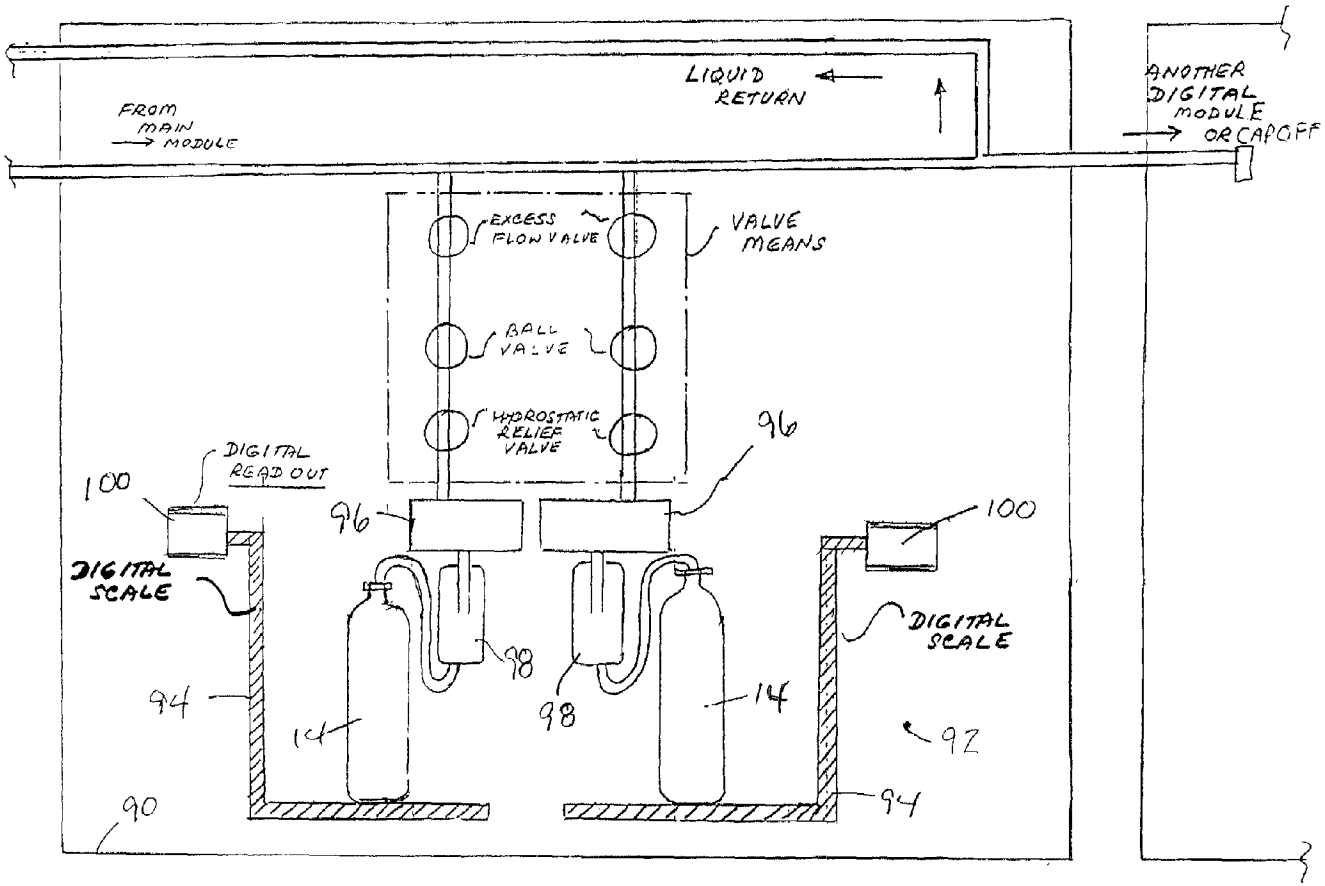
FIG. 3 is a schematic illustration of a second alternative embodiment mobile filling station of the present invention.

FIG. 3 illustrates a second alternative embodiment for the second cabinet 90 of the mobile fill station 60 shown in FIGS. 2A and 2B. In this embodiment, cabinet 90 includes a digital weight indicator 92 comprising an electronic scale 94 and a computer control 96. The computer control 96 is a part of the dispensing assembly 98 which includes a digital ultra low power indicator intrinsically safe instrument, battery pack and safe area data interface box and analog I/O board, trickle charge and barrier set and intrinsically safe interface cable, and internal pilot operated solenoid valves connected to two LPG hose and quick acting adapter filler. The digital scale 94 has a digital readout 100. In this embodiment, the filling of the propane cylinders 14 stops automatically as the total weight of the cylinder reaches the pre-set computer limit. The scale is a Fairbanks Electronics Scale equipped with a load cell of 200 lbs. (90 kg).

Figure 4A:
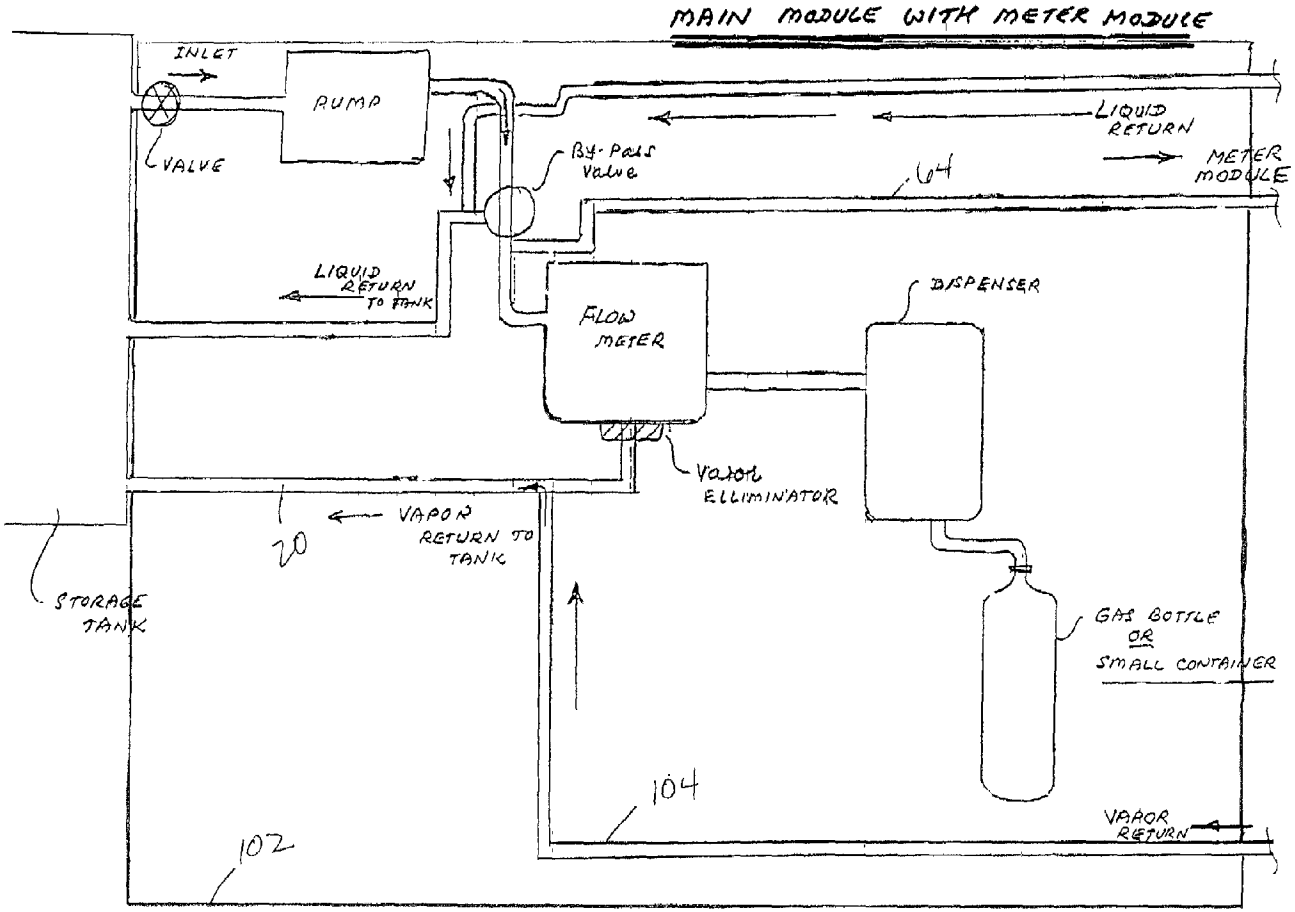
FIGS. 4A and 4B are a schematic illustration of a third alternative embodiment mobile filling station of the present invention.
Figure 4B:
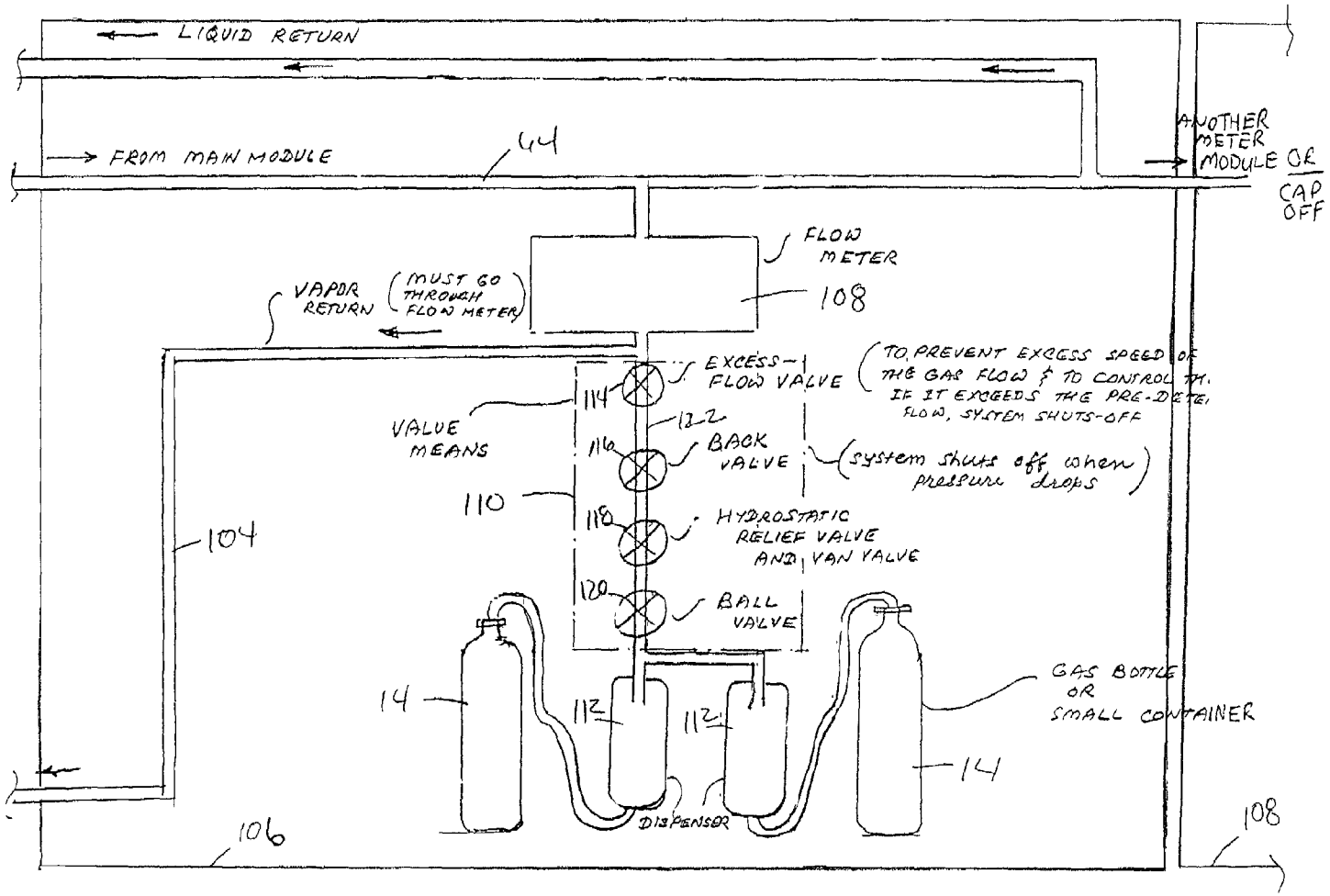

FIGS. 4A and 4B illustrate a third alternative embodiment mobile filling station 100 in accordance with the present invention. FIG. 4A illustrates a first cabinet 102 (although shown in a simplified form) is identical to cabinet 50 of FIG. 2A with the exception of having an additional vapor return line 104 attached to vapor return line 20 and extending to a second cabinet 106 shown in FIG. 4B. In this embodiment the propane cylinders 14 are filled in cabinet 106 by propane entering from in line 64 through flow meter 108 and through valve means 110 and into dispenser 112. The valve means 110 includes excess flow valve 114, back valve 116, hydrostatic relief valve 118 and ball valve 120. The valve means is connected by pipe 122. Vapor return line 104 vents the propane vapor from the flow meter 108 back to the storage tank 12. The filling stops in this version when the operator sees the amount of propane on the flow meter and then stops the flow. In cabinet 106 the valve means is utilized to prevent excess speed of the gas flow and to control the gas if it exceeds the predetermined flow rate to shut off the gas flow when pressure drops below a preset limit. In line 64 extends through cabinet 106 to a third cabinet 108 if desired or can be capped off.

Although the present invention has been described and illustrated with respect to four embodiments thereof, it is to be understood that many variations can be achieved without departing from the scope of the invention. For example, any number of cabinets containing any one of the various methods for filling the cylinder can be incorporated. The cabinets can contain the flow meter, scales, or digital scales in any combination depending upon the intended end use of the system.

What is claimed is:

1. A mobile fill station for filling propane cylinders from a storage tank comprising:

a first cabinet;

a pump located in the first cabinet and connected to the storage tank by a first gas line;

a flow meter located in the first cabinet and connected to the pump by a second gas line;

a bypass valve positioned in the second gas line;

a return gas line positioned between the bypass valve and the storage tank;

a first vapor return line positioned between the flow meter and the storage tank;

a dispenser connected to the flow meter by a third gas line for filling the propane cylinder; and a motor for driving the pump.

2. The station of claim 1 further comprising a fourth gas line extending from the second gas line out of the first cabinet and into a second cabinet.

3. The station of claim 2 wherein the second cabinet includes:

a valve means connected to the fourth gas line by a fifth gas line; and a dispenser connected to the fifth gas line.

4. The station of claim 3 wherein the second cabinet further comprises a scale for weighing the propane cylinder and a hydraulic automatic stop to stop filling the propane cylinder when a predetermined weight of the propane cylinder is achieved.

5. The station of claim 3 wherein the valve means includes an excess flow valve, a ball valve and a hydrostatic relief valve.

6. The station of claim 3 wherein the second cabinet further comprises a computer controlled digital weight indicator for the propane cylinder to automatically stop filling the propane cylinder when a predetermined weight of the propane cylinder is achieved.

7. The station of claim 2 wherein the fourth gas line extends through the second cabinet and into a third cabinet.

8. The station of claim 7 wherein the third cabinet includes a valve means connected to the fourth gas line by a sixth gas line; and a dispenser connected to the sixth gas line.

9. The station of claim 8 wherein the third cabinet further comprises a scale for weighing the propane cylinder and a hydraulic automatic stop to stop filling the propane cylinder when a predetermined weight of the propane cylinder is achieved.

10. The station of claim 8 wherein the valve means includes an excess flow valve, a ball valve and a hydrostatic relief valve.

11. The station of claim 8 wherein the third cabinet further comprises a computer controlled digital weight indicator for the propane cylinder to automatically stop filling the propane cylinder when a predetermined weight of the propane cylinder is achieved.

12. The station of claim 3 wherein the second cabinet further includes a flow meter connected to the fourth gas line by a fifth gas line.

13. The station of claim 12 wherein the valve means comprises an excess flow valve, a back valve, a hydrostatic relief valve and a ball valve positioned in the sixth gas line below the flow meter to stop filling the propane cylinders based upon a drop in pressure.

14. The station of claim 12 wherein the second cabinet includes a second vapor return line which extends from the sixth gas line to the first vapor return line in the first cabinet.

15. A mobile fill station for filling propane cylinders from a bulk propane storage tank comprising:

a first cabinet fluidly connected to the bulk storage tank having a dispenser to manually fill the propane cylinders by volume; and a second cabinet fluidly connected to the first cabinet and having a dispenser to fill the propane cylinders automatically by weight.

16. The station of claim 15 further comprising a third cabinet fluidly connected to the second cabinet having a dispenser to manually fill the propane cylinders by volume.

17. The station of claim 15 further comprising a third cabinet fluidly connected to the second cabinet having a dispenser to automatically fill the propane cylinders by weight.

18. The station of claim 15 wherein the second cabinet includes a beam scale with a hydraulic automatic stop such that filling of the propane cylinders is stopped as a total weight of the propane cylinder reaches a pre-set scale limit.

19. The station of claim 15 wherein the second cabinet further comprises a computer controlled digital weight indicator for the propane cylinders to automatically stop filling when a predetermined weight is achieved.

* * * * *